US006312103B1

(12) United States Patent
Haluzak

(10) Patent No.: US 6,312,103 B1
(45) **Date of Patent: *Nov. 6, 2001**

(54) SELF-CLEANING TITANIUM DIOXIDE COATED INK-JET PRINTER HEAD

(75) Inventor: Charles C Haluzak, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/159,080

(22) Filed: Sep. 22, 1998

(51) Int. Cl.[7] ..... B41J 2/135
(52) U.S. Cl. ..... 347/45
(58) Field of Search ..... 347/47, 45

(56) References Cited

U.S. PATENT DOCUMENTS

| | | | |
|---|---|---|---|
| 4,773,971 | 9/1988 | Lam et al. | 204/11 |
| 5,137,607 | 8/1992 | Anderson et al. | 204/59 |
| 5,305,015 | 4/1994 | Schantz et al. | 346/11 |
| 5,387,440 | 2/1995 | Takemoto et al. | 427/443 |
| 5,434,606 | 7/1995 | Hindagolla et al. | 347/45 |
| 5,545,337 | 8/1996 | Hong | 210/761 |
| 5,595,785 | 1/1997 | Hindagolla et al. | 427/271 |
| 5,598,193 | 1/1997 | Halko et al. | 347/45 |
| 5,635,966 | 6/1997 | Keefe et al. | 347/43 |
| 5,751,313 * | 5/1998 | Miyashita et al. | 347/45 |
| 5,779,912 | 7/1998 | Gonzales-Martin et al. | 210/748 |

OTHER PUBLICATIONS

R. Wong et al., *Nature*, vol. 388, pp. 431–432 (Jul. 31, 1997).
S. Strauss (1966) *Technology Review*, vol. 99 (#2) pp. 23–25.
I. Sopyan, et al., (1966) *Journal of Electroanaytical Chemistry*, vol. 415., pp. 183–186.
C. D. Wheeler, (Oct. 1994), *Soap Cosmetics–Chemical Specialities*, vol. 70, (#10), p. 54(2).
M.Fatsuhara et al. (Nov. 1996), *J. Electrochem. Soc.*, vol. 143, No. 11, pp. 3743–3746.

* cited by examiner

*Primary Examiner*—John Barlow
*Assistant Examiner*—Michael S. Brooke

(57) ABSTRACT

A novel titanium dioxide coated inkjet printer head and a process of producing the titanium dioxide coated print head are disclosed herein. The coated print head catalytically decomposes water and organic materials and reduces or eliminates ink droplet formation on the print head and is therefore self-cleaning. The thickness of the wettable titanium dioxide layer is usually between about 0.1 and 1000 micron. Other printer surfaces subject to ink or oils contamination can also be coated with titanium dioxide to produce self-cleaning printer surfaces. Optionally light is used to enhance the catalytic properties of the titanium dioxide.

17 Claims, 1 Drawing Sheet

SELF-CLEANING TITANIUM DIOXIDE COATED INK-JET PRINTER HEAD

BACKGROUND OF THE INVENTION

1. Field of the Invention

The present invention concerns the use of inkjet printer orifices which are coated with a continuous or discontinuous layer of titanium dioxide. The titanium dioxide acts as a catalyst at ambient pressure and temperature (optionally in the presence of light) to decompose excess ink components (solvents, etc.) to keep the inkjet nozzle free of excess ink and allowing for improved inkjet printing. Light irradiated $TiO_2$ has an extremely small wetting angle of between about 0.0 to 1.0°.

2. Description of the Problem and Related Art

It is well known that when an inkjet printer is operated that drop trajectory and head/printer cleanliness problems develop due to uncontrolled orifice plate surface energy and/or wetting characteristics. This results in a buildup of ink or ink droplets on the print head which affects ink drop trajectory.

Various methods have been used to reduce or eliminate ink buildup have been used including coating the print head with a hydrophobic material to prevent ink head wetting and coating the print head with a varying alternating hydrophilic and hydrophilic coatings to essentially "pump" ink drops on the head away from the ink head orifice to clean the ink head area around the orifice. See for example, Takemoto et al. in U.S. Pat. No. 5,387,440; and Hindagolla et al. in U.S. Pat. Nos. 5,434,606 and 5,595,785.

Orifice plates are mounted to ink-jet pens and include orifices through which ink drops are expelled by any one of a number of drop ejection systems. One such system is known as the thermal type and includes a thin-film resistor that is intermittently heated for vaporizing a portion of ink near an adjacent orifice. The rapid expansion of the vapor forces a drop of ink through the orifice. A partial vacuum or "back pressure" is maintained within the pen to keep ink from leaking out of the orifices when the drop ejection system is inactive.

There may be several orifices formed in a single orifice plate, each orifice having an associated drop ejection system for supplying a drop of ink on demand as the ink jet pen scans across a printing medium.

Some of the ink that is ejected through the orifice does not reach the printing medium (e.g., paper, polymer, etc.), and instead collects on the outer surface of the orifice plate (that is, the surface facing the printing medium). Some of this residual ink accumulates or puddles adjacent to the edge of the orifice and may alter the trajectory of the subsequently ejected drops, thereby reducing the overall quality of the printed image.

Residual ink on the outer surface of the orifice plate also tends to trap stray particles, such as paper fibers. The fibers may be held by the ink near the orifice to partially block the orifice and interfer with the ink drop ejections. Further, residual ink on the orifice plate outer surface may collect near the orifice into a thin sheet that is in fluid communication with ink stored in a supply chamber that is just inside the orifice. As a result, a continuous ink path between the chamber and the outer surface of the orifice plate may be formed. The path promotes ink leakage through the orifice. Accordingly, the outer surface of an inkjet pen orifice plate should be designed so that ink does not puddle in the vicinity of the orifice nor accumulate on the plate in an amount that may trap fibers and facilitates leakage as described above.

The inner surface of an orifice plate is exposed to the supply of ink. The ink flows over the inner surface to each orifice. Preferably, the inner surface of the orifice plate, including the portion defining the orifice, should facilitate the flow of ink from the supply through the orifice so that the drop ejection system receives a continuous and uniform flow of ink.

Additional references of interest include, for example:

A. Gonzalez-Martin et al. in U.S. Pat. No. 5,779,912 disclose a method and an apparatus for mineralizing organic contaminants in water or in air provides a photochemical oxidation in a unique two-phase or three-phase boundary system found in each pore of a $TiO_2$ membrane in a photocatalytic reactor.

D. J. Halko et al. U.S. Pat. No. 5,598,193 disclose a surface treatment with organic compounds to produce monolayers on an orifice plate for an inkjet printer.

G. T. Hong, U.S. Pat. No. 5,545,337 describes a method of producing a layer of titanium dioxide on a surface using temperatures up to 700° C.

M. A. Anderson et al. in U.S. Pat. No. 5,137,604 disclose a reactor vessel using metal oxide (e.g. $TiO_2$) ceramic membranes.

S. L. Hindagolla et al. in U.S. Pat Nos. 5,434,606 and 5,595,785 disclose an orifice plate for an inkjet pen.

B. J. Keefe et al. in U.S. Pat. No. 5,635,966 disclose an edge feed in a delivery thermal inkjet printhead structure and a method of fabrication.

K. Takemoto et al. in U.S. Pat. No. 5,387,440 disclose a nozzle plate for an inkjet recording apparatus and method of preparing a nozzle plate.

C. A. Schantz et al. in U.S. Pat. No. 5,305,015 disclose a laser ablated nozzle member of an inkjet printhead.

S. T. Lam et al. in U.S. Pat. No. 4,773,971 disclose a reusable mandrel and a method of making the mandrel which has a substrate with a conductive film layer.

Other references of general and specific interest include:

R. Wong et al. *Nature*, Vol. 388, pp. 431–2 (Jul. 31, 1997).

S. Strauss (1996) *Technology Review*, Vol. 99 (#2) pp. 23–25.

I. Sopyan, et al. (1996) *Journal of Electroanaytical Chemistry*, Vol. 415, pp.183–186.

C. D. Wheeler (October 1994) *Soap-Cosmetics-Chemical Specialities*, Vol. 70 (#10), P. 54(2).

All articles, references, patents, applications, standards, etc. cited in this application are incorporated herein by reference in their entirety.

It would be useful to have a modified inkjet nozzle having a thin coating of titanium dioxide and a method with which there is improved printing on a medium. The present invention provides such an improved nozzle and an improved method.

SUMMARY OF THE INVENTION

A novel coated ink jet printer head, method of manufacture of the novel coated ink jet head, a novel $TiO_2$ ink jet head coating and method of application are disclosed herein.

Ink and ink droplet buildup on an inkjet printer head is eliminated by coating the print head with $TiO_2$ which can be applied by sputtering, sintering or by coating the head surface with a $TiO_2$ solution and curing the coating on the print head.

Other surfaces of printers which are exposed to ink contamination can also be coated with $TiO_2$ to provide self-cleaning surfaces which reduce maintenance and downtime on the printers.

An object of this invention is to provide a new, surface treatment of 0.0 degree contact angle to both water and oils, which can be used alone to control head surface energy or with a hydrophobic surface treatment to yield differential surface energy control.

A further object of this invention is to provide self-cleaning ink jet print head surface treatment with titanium dioxide as a catalyst in the self-cleaning activity which might in theory will last for extended periods ("forever") since it is not consumed in the self-cleaning reaction.

It is a still further object of this invention to provide a physically robust (abrasion resistant) new orifice coating of $TiO_2$.

It is another object of the invention to provide a novel $TiO_2$ coating showing multiple methods and application technologies lending flexibility to how and where the coating can be applied.

It is still a further object of this invention to provide an $TiO_2$ ink jet coating which can be masked and etched to provide differential surface energy control.

Yet another object is to produce a printer having self-cleaning surfaces.

Another embodiment of the present invention is an orifice plate for an inkjet pen, which plate comprises:

a plate having an inner surface and an outer surface wherein the inner surface portion defining an orifice that extends through the plate between the inner surface and the outer surface;

the outer surface having a first outer surface portion surrounding the orifice, a second outer portion and a third outer surface portion surrounding the second outer surface portion, wherein the second surface portion is less wettable with respect to ink than the first outer surface portion and the third outer surface portion; and the orifice and outer surface joining to define an edge, said first outer surface portion being adjacent to the edge and separated from the orifice by the edge;

wherein the first outer portion (and optionally the third outer portion) comprises a layer of titanium dioxide having a first wetting characteristic such that water and/or ink on the surface have a wetting characteristic and form a contact angle of between about 0 and 20°. Optionally, the nonwetting surface and the wetting surface described are interchanged and this configuration also shows improved printing results.

An additional embodiment of the present invention is an improved method of inkjet printing, which method comprises:

(a) utilizing the orifice plate for an inkjet pen described hereinabove having a surface coating of titanium dioxide;

(b) decomposing catalytically water, organic dye, organic pigment, solvent or combinations thereof which contacts the titanium dioxide surface thereby self cleaning the titanium dioxide surface and reducing the misdirection of the ink. Optionally, the catalytic activity of the titanium dioxide layer is increased by contact with light.

DETAILED DESCRIPTION OF THE INVENTION AND PREFERRED EMBODIMENTS

Definitions

As used herein:

"Wiping/servicing" of means printer head refers to conventional wipers used in inkjet printers.

"KAPTON®" refers to the commercially available fluorinated polyethylene polymer trademarked by the Dupont Co. of Wilmington, Del.

"Sputtering means" refers to vacuum-based physical vapor deposition (PVD) or chemical vapor deposition (CVD) which is conventional in the art e.g. the integrated circuit art.

"FIT" refers to a fully integrated inkjet.

"Contact angle" refers to the angle between a drop on a surface and the surface formed by the tangent to the curvature of the drop adjacent to the drop contact with a surface (which is presumed to be flat).

Figure 1:
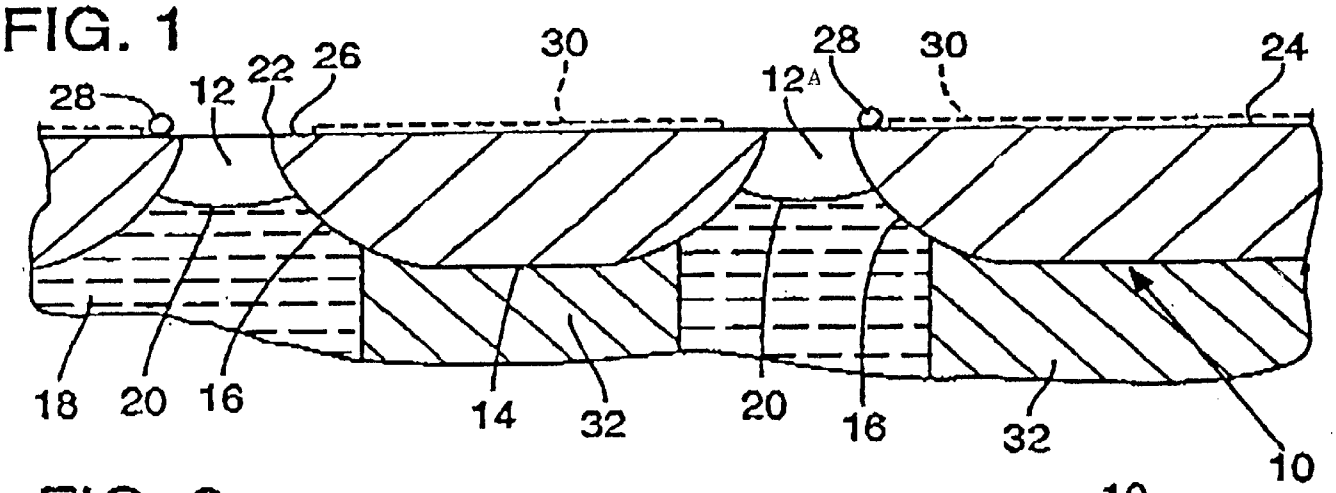
FIG. 1 is a diagram showing a side cross-sectional view of a portion of an orifice plate that is formed in accordance with the present invention.
Figure 2:
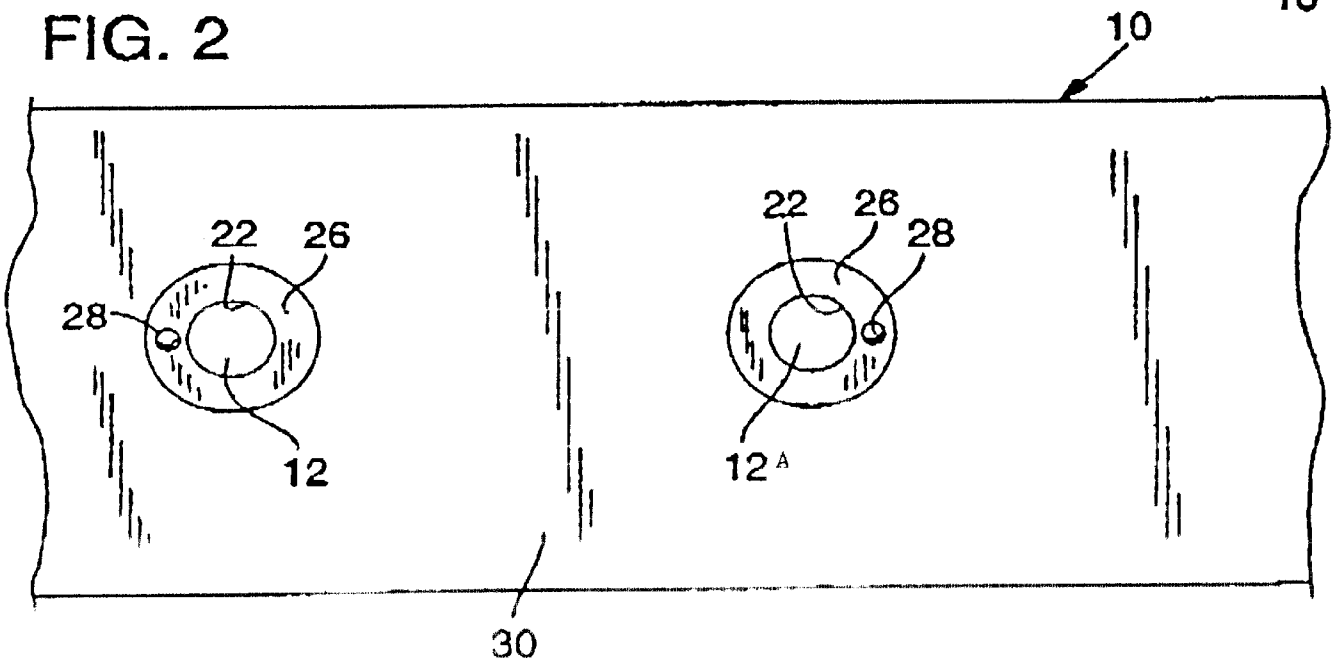
FIG. 2 is a top plan view of an orifice plate showing the outer surface thereof.

As shown in FIGS. 1 and 2, the present invention includes an orifice plate 10 for a conventional inkjet pen. The orifice plate 10 is preferably a sheet of gold-plated nickel constructed by conventional electroforming techniques or polymer such as KAPTON®. Other metals besides nickel may be used to form the underlying sheet of the orifice plate. Further, other metals, such as palladium, rhodium, silver, and copper, may be used to plate the underlying sheet. The plate includes an array of orifices 12 and 12A through which ink drops are selectively propelled by known ejection means, such as provided by a thermal type ejection system. The plate inner surface 14 includes somewhat funnel-shaped portions 16 that define each orifice.

Ink 18 is drawn by capillary force along the inner surfaces 14 and 16 of the plate 10 into orifice 12 and 12A. A partial vacuum or back pressure within the inkjet pen keeps the ink from passing completely through the orifice 12 and 12A in the absence of an ejecting force. Whenever drops of ink are not being fired through the orifice, the ink resides within the orifice with a meniscus 20 just inside the outer edge 22 of the orifices.

The drop ejection system (not shown) is associated with orifice 12 and 12A for selectively ejecting drops of ink through the orifice to a printing medium, such as paper. Orifices 12 and 12A have been shown as generally funnel-shaped in section. It is understood, however, that the orifices may have any one of a variety of shapes.

The surfaces 26, 30, etc. are characterized with two extremes as wetting or non-wetting. In other words, the printer head is a plate (10) which has an inner surface (of 16) and an outer surface (26) wherein the inner surface portion defines an orifice (12) that extends through the plate (10) between the inner surface (of 16) and the outer surface (26). The outer surface has a first outer surface portion (26) surrounding the orifice (12) and second outer portion surrounding the first outer surface portion and a third outer surface portion (30) surrounding the second outer surface portion wherein, the second surface portion is less wettable with respect to ink than the first outer surface portion (26) and the third outer surface portion (30). The orifice (12) and the first outer surface portion (26) join to define an edge (22) said first outer surface portion (26) being adjacent to the edge (22) and separated from the orifice (12) by edge (22). The first outer surface (26) comprises a layer of titanium dioxide having a first wetting characteristic such that ink on surface (26) has a wetting characteristic and forms a contact angle of between about 0 and 20° C. In one embodiment, the wetting region (first outer surface portion 26) and non-wetting region (third outer surface portion 30) are reversed. In one embodiment, the entire outer surface (26 and 30) is a wetting surface. In one embodiment, both outer surfaces (26 and 30) of plate (10) are coated with a titanium dioxide layer and are thus made wettable.

The outer surfaces 24 and 30 of the orifice plate 10 have layers thereon for affecting its wetting characteristics with respect to the ink.

The surface of the orifice plate (annular area 26 and surrounding area 30) in one embodiment is made nonwetting. Any residual ink on the surface will tend to bead up and be easily removed with a wiper, vacuum, or any other servicing technique. Further, the wiper (not shown) is preferably made wetting with respect to the residual ink so that the ink will rapidly transfer from the orifice plate to the wiper.

The annular area 26 or portion surrounding orifice 12 and 12A of the orifice plate 10 is made nonwetting with respect to the ink. Hence, any residual ink 28 on this area will bead up away from the edge 22 of orifice 12 so as not to interfere with the subsequent ejection of ink drops. Further, the contamination of the surface with paper fibers or other substances will be minimized, thereby allowing for improved ejection of ink drops.

In another embodiment, the remaining area of the plate 30 (or the portion surrounding the annular areas as shown by the dotted line in FIG. 1) is made wetting with respect to the ink. In this manner, any residual ink which comes into contact with this wetting area will flow away from orifice 12 and 12A and eventually off the plate (or can be wiped from the plate by the use of a wiper).

In the present invention, when $TiO_2$ is used for the wetting area 30 then the water, dye, pigment, solvent, etc. are catalytically decomposed. Optionally, in the presence of ambient light, natural light, or more specifically, at wavelengths less than 380 microns (UV), the catalytic activity of the titanium dioxide layer is enhanced.

Various techniques can be utilized to apply the desired layer to the selected areas of the orifice plate 10. For instance, the orifice plate can be immersed in a solution containing the layer. The chemical bonding of the layer to the gold-plated surface occurs rapidly. Alternatively, if different layers are to be applied to each side of the orifice plate, or if only one side is to treated, the solution containing the layer can be sprayed onto the appropriate side of the plate. Further, the layer may be applied to the plate with the use of a stamp or pad absorbed with the solution. In any case, the application of the layer compounds in accordance with the present invention can be quickly accomplished and is cost efficient compared to other known methods of altering the wetting characteristics of surfaces.

More specifically, to treat the outer surface 24 of the orifice plate 10 with layers as shown in FIG. 2. A photo resist mask is first applied by known techniques to the area 26 which is to be made nonwetting. A wetting layer is then applied the outer surface of the plate by using one of the techniques as discussed above. The photo resist is then removed from the plate. The plate is then treated with a nonwetting layer by either dipping it in or spraying it with a solution of nonwetting layer. Thus, the plate will have a nonwetting layer in the annular regions 26 surrounding the orifices, and a wetting layer in the remaining area 30. It is contemplated that other methods are used to apply the wetting and nonwetting layers to the selected areas of the orifice plate.

Inkjet printer manufacturers continue to struggle with drop trajectory and head/printer cleanliness issues related to uncontrolled orifice plate surface energy, or "wetting", characteristics. The problem is not only related to the numerical value of contact angle (a measure of "wettability"), but, the fact that contact angle is not controlled in current manufacturing lines and actually varies with time as ink interacts in the drop delivery system (pen and printer interaction).

The present invention addresses these problems by use of a novel inkjet head coating dioxide ($TiO_2$), that has the amazing properties of having a 0.0 deg. contact angle (hydrophilic, or highly wetting) and is "self-cleaning". By "self-cleaning" it is meant that stray organic material (ink) droplets are catalytically decomposed on the surface of the titanium dioxide. Droplets do not form or a puddle of ink cannot occur near the print head orifice or on the print head. This means that any puddle on the orifice is virtually reduced to a few monolayers of ink in height. This puddle height reduction dramatically decreases the ability of a puddle to attach itself to the main ink ejection drop causing misdirection of the ink. $TiO_2$ is a catalyst for decomposing organic material which is reacted with oxygen and also when exposed to ambient or ultraviolet light (UV).

1. Surface Energy Control

Further self-cleaning action are provided by using both hydrophilic and hydrophobic surfaces adjacent to each other on the orifice plate to produce the effect of leaving the bore area free of puddles. This concept is called "differential surface energy control" and can be used to move or "pump" excess fluid on the orifice plate wherever it is desired, similarly to how a differential pressure moves fluid in a pipe.

Application of $TiO_2$ is performed by multiple means, e.g., sputter deposition, sintering powder, or sol spin-on formation. The sol application is most promising because the cure can be performed at low (120° C.) temperatures after spin-on application. Preferred thickness for the $TiO_2$ surface coating ranges between about 0.01 and 1000 micron, preferably between about 200 Å to about 10,000 Å (0.02 micron to about 1 micron).

There are multiple application processes available for titanium dioxide. The $TiO_2$ coating for metal (Ni+(Au, or Pd, or Rh)) orifice plates that have been completely processed (sheet form) but, not singulated and attached to the die via the "Barrier" glue layer can be applied by sputter deposition of the $TiO_2$ onto the top of the sheet in a vacuum sputter chamber. This operation primarily coats only the topside of the plate making it super-hydrophilic and self-cleaning. The underside can be coated by flipping the plate in the chamber. The inside of the chamber would not be coated because sputtering is essentially a "line-of-sight" process.

The $TiO_2$ coating for KAPTON® type orifice plates that have not been laser ablated, but will eventually be laser ablated and singulated for head attach via the "Barrier" glue layer can be applied by application method is to use of a sol-gel application where the KAPTON® sheets would be coated in bulk form by either spin, roll, extrusions or meniscus coating. The sol-gel bake temperature is approximately 120° C. as in the literature. This should not be a destructive temperature for this polyimide-based "plate". The KAPTON® is then be ready for laser ablation. The laser enters the KAPTON® from the "entrance" side of the plate (not the $TiO_2$ coated side) and exits from the KAPTON® where the inkjet drop exits. This means that the $TiO_2$ coating should not adversely affect the bore shape because the laser doesn't come in contact with it until the final "pulses" leave the KAPTON®. This only coat the topside of the plate making it super-hydrophilic and self-cleaning. The inside of the chamber would not get coated because the sol application was prior to ablation.

The $TiO_2$ coating can be masked and etched, so it is possible to pattern it any way desired on an orifice. This is particularly true for FIT-type devices where the orifice process is accomplished in-situ on the entire silicon substrate. This is one way the differential surface energy control concept can be manifested.

The proposed titanium dioxide layer treatment is also oleophilic at the same time that it is hydrophilic. This means that titanium dioxide also has a tendency to exhibit a low contact angle with "oily" substance, such as glycerol trioreate and hexadecane. This olephilic/hydrophilic activity is an unusual physical property of $TiO_2$.

2. Self Cleaning:

Research has demonstrated that properly prepared coatings of titanium dioxide in the presence of natural sunlight, UV lamps, and even broad-spectrum (fluorescent lighting), can disassociate organic molecules and even water (see Strauss (1996)). Such a catalyzing surface treatment is being considered for use in commercial applications such as hospital tiles. In hospitals it has proven effective in killing bacteria on surfaces. It is also being considered as a special pigment in paints that may provide "self-cleaning" residential walls. Since the titanium dioxide acts as a catalyst, it is not used up in the reaction. Therefore, it should continue working as long as the layer is not abraded from the surface.

The same concept is applied to ink-jet heads. One uses a printer service-station that incorporates a UV light source which irradiates the orifice plate between firings. It uses light long enough to remove the trace ink crust that was missed by the service-station wiper.

Additionally, this titanium dioxide layer is applied to virtually any surface in the printer mechanism that surface energy control and "cleanliness" from organic and living micro-organisms is of interest. It coats the surfaces in the service station itself, or the flex circuitry, or even the paper handling mechanism to eliminate or minimize "dust".

3. Chemical Resistance:

Titanium metal is an extremely robust material which is reported to form it's own protective oxide in ambient atmospheric conditions, therefore, producing a titanium dioxide layer which is also quite stable. It has nearly the same enthalpy of formation as silicon dioxide, which is also known to be chemically inert to a wide range of substances.

4. Abrasion Resistance:

$TiO_2$ has a reported scratch resistance of 6–6.5 on the Moh scale which compares very well with silicon at 7.0 and silicon dioxide at 7.0 (higher value implies greater scratch resistance). This speaks well for the expected ability of the material to withstand a wide range of surface "abuses", such as repeated scrubbing with solvents and/or basic solutions.

The novel invention described above is better understood by the following examples. These examples are presented to be illustrative and descriptive only. They are not to be construed to be limiting in any way.

EXAMPLE 1

A metal (Ni+(Au, or, Pd, or Rh)) orifice plate that has been completely processed (sheet form) but, not singulated and attached to the die via the "Barrier" glue layer. It is sputter deposited with $TiO_2$ to a thickness of about 200 Angstroms onto the top of the sheet in a vacuum sputter chamber at a temperature of between 100 and 500° C. The resultant coated head is hydrophilic and prevents puddle formation during printer operation. Orifice sheets are treated on both sides by dipping (see U.S. Pat. No. 5,137,607). This operation produces a hydrophilic inner base surface which has been found to improve refill frequencies (see U.S. Pat. No. 5,598,193 at FIG. 3, and at column 3, line 23).

EXAMPLE 2

A KAPTON® type orifice plate that has not been laser ablated, but, will eventually be laser ablated and singulated for head attach via the "Barrier" glue layer is sol-gel application coated by either spin, roll, or, meniscus coating. The sol-gel is then baked temperature. at approximately 120° C. The resulting coated printer head (the titanium dioxide layer is about 1 micron) is hydrophilic and prevents drop formation during inkjet printer operation.

While only a few embodiments of the invention have been shown and described herein, it will become apparent to those skilled in the art that various modifications and changes can be made in the construction of a titanium dioxide coated inkjet nozzle and an improved method of printing without departing from the spirit and scope of the present invention. All such modifications and changes coming within the scope of the appended claims are intended to be carried out thereby.

I claim:

1. An inkjet print head having an outer surface plate which is coated with a layer of titanium dioxide wherein the outer surface layer of titanium dioxide is a catalyst to decompose any ink deposited on the outer surface, which surface is therefore self-cleaning of ink; and wherein the titanium dioxide layer has a thickness of between about 0.01 and 1000 micron and wherein the outer surface plate further comprises:

an inner surface and an outer surface wherein the inner surface portion defines an orifice that extends through said plate between the inner surface and the outer surface; wherein the outer surface has a first outer surface portion surrounding the orifice, a second outer portion surrounding the first outer portion and a third outer surface portion surrounding the second outer surface portion, wherein the second surface portion is less wettable with respect to ink than the first outer surface portion and the third outer surface portion: and the orifice and first outer surface portion join to define an edge, said first outer surface portion being adjacent to the edge and separated from the orifice by the edge;

wherein the first outer surface portion comprises a layer of titanium dioxide having a first wetting characteristic such that ink on the surface has a wetting characteristic and forms a contact angle of between about 0 and 20°.

2. An inkjet print cartridge comprising the inkjet print head of claim 1 and an ink reservoir wherein said inkjet print head is coated with a layer of titanium dioxide.

3. The inkjet print cartridge of claim 2 wherein the thickness of the layer of the titamium dioxide coating is between about 0.1 micron to 1000 micron.

4. An improved method of inkjet printing, which method comprises:

(a) utilizing the inkjet print head of claim 1 having an outer surface coating of titanium dioxide, in conjunction with an inkjet pen;

(b) contacting the outer surface coating of titanium dioxide with ink;

(c) decomposing catalytically water, organic dye, organic pigment, solvent or combinations thereof of the ink which contacts the titanium dioxide surface thereby self-cleaning the titanium dioxide surface and reducing the misdirection of the inkjet ink.

5. The improved method of claim 4 wherein the titanium dioxide layer is between about 0.1 and 1000 microns.

6. The inkjet print head of claim 1 wherein the titanium dioxide thickness is between about 0.02 and 1 micron.

7. The inkjet print head of claim 1 wherein the entire outer surface is a wetting surface.

8. The ink jet print head of claim 7 wherein all outer surfaces of the plate are coated with a titanium dioxide layer and are thus made wettable.

9. An inkjet print head for an inkjet pen, which print head has an outer surface plate, which plate itself comprises:

an inner surface and an outer surface wherein the inner surface portion defines an orifice that extends through said plate between the inner surface and the outer surface; wherein the outer surface has a first outer surface portion surrounding the orifice, a second outer portion surrounding the first outer portion and a third outer surface portion surrounding the second outer surface portion, wherein the second surface portion is less wettable with respect to ink than the first outer surface portion and the third outer surface portion: and the orifice and first outer surface portion join to define an edge, said first outer surface portion being adjacent to the edge and separated from the orifice by the edge;

wherein the first outer surface portion comprises a layer of titanium dioxide having a first wetting characteristic such that ink on the surface has a wetting characteristic and forms a contact angle of between about 0 and 20°.

10. The inkjet print head produced according to claim 9 wherein the first outer surface portion is comprised of up to 99% titanium dioxide.

11. The inkjet print head produced according to claim 9 wherein the first outer surface portion has a wetting angle with respect to the ink of between about 0.0 and 10°.

12. The inkjet print head produced according to claim 9 wherein the thickness of the titanium dioxide layer is between about 0.1 and 1000 micron.

13. The improved method of claim 12 wherein the wetting angle of the titanium dioxide layer with water, organic material or combinations thereof is between about 0.1 and 10°.

14. The inkjet print head of claim 9 wherein the wetting first outer surface portion and non-wetting third outer surface portion are reversed.

15. The inkjet print head of claim 9 wherein:

the thickness of the titanium dioxide layer is between about 0.02 and 1 micron; and the contact angle of water or ink on the surface is between about 0.0 and 5°.

16. An improved method of inkjet printing, which method comprises:

(a) utilizing an inkjet print head having an outer surface plate which is coated with a layer of titanium dioxide wherein the outer surface layer of titanium dioxide is a catalyst to decompose any ink deposited on the outer surface, which surface is therefore self-cleaning of ink; and having an outer surface coating of titanium dioxide, in conjunction with an inkjet pen and wherein the outer surface plate further comprises:

an inner surface and an outer surface wherein the inner surface portion defines an orifice that extends through said plate between the inner surface and the outer surface; wherein the outer surface has a first outer surface portion surrounding the orifice, a second outer portion surrounding the first outer portion and a third outer surface portion surrounding the second outer surface portion, wherein the second surface portion is less wettable with respect to ink than the first outer surface Portion and the third outer surface portion: and the orifice and first outer surface portion join to define an edge, said first outer surface portion being adjacent to the edge and separated from the orifice by the edge;

wherein the first outer surface portion comprises a layer of titanium dioxide having a first wetting characteristic such that ink on the surface has a wetting characteristic and forms a contact angle of between about 0 and 20°

(b) contacting the outer surface coating of titanium dioxide with ink;

(c) decomposing catalytically water, organic dye, organic pigment, solvent or combinations thereof of the ink which contacts the titanium dioxide surface thereby self-cleaning the titanium dioxide surface and reducing the misdirection of the ink jet ink, while (d) irradiating with light the titanium dioxide layer simultaneously in step (c) to increase the rate of catalytic decomposition of water, organic dye, organic pigment, solvent or combinations thereof of the ink, wherein the titanium dioxide layer has a thickness of between about 0.01 and 1000 micron.

17. The compound method of claim 16 wherein the light is selected from ultraviolet (UV), visible (VIS), infrared (IR) or combinations thereof.

* * * * *